US006789796B2

(12) United States Patent
Cherven

(10) Patent No.: US 6,789,796 B2
(45) Date of Patent: Sep. 14, 2004

(54) METHOD OF PLAYING A DICE GAME

(76) Inventor: Eugene Joseph Cherven, 18045 Sunburst Dr., Monument, CO (US) 80132

( * ) Notice: Subject to any disclaimer, the term of this patent is extended or adjusted under 35 U.S.C. 154(b) by 0 days.

(21) Appl. No.: 10/184,435

(22) Filed: Jul. 1, 2002

(65) Prior Publication Data

US 2004/0000755 A1 Jan. 1, 2004

Related U.S. Application Data

(60) Provisional application No. 60/310,413, filed on Aug. 6, 2001.

(51) Int. Cl.[7] ..... A63F 9/04
(52) U.S. Cl. ..... 273/146; 273/274
(58) Field of Search ..... 273/146, 274; D21/372

(56) References Cited

U.S. PATENT DOCUMENTS 1,527,937 A * 2/1925 Tienken ..... 273/146
4,247,114 A * 1/1981 Carroll ..... 273/274
5,169,148 A * 12/1992 Wheeler ..... 273/146
5,407,208 A * 4/1995 Keller et al. ..... 273/274
5,556,101 A * 9/1996 Jabro ..... 273/274
5,775,696 A * 7/1998 Sidlow et al. ..... 273/274
5,806,847 A * 9/1998 White et al. ..... 273/309
6,062,563 A * 5/2000 de Keller ..... 273/274
6,123,333 A * 9/2000 McGinnis, Sr. et al. .... 273/146
6,123,335 A * 9/2000 Adkins ..... 273/292
6,257,580 B1 * 7/2001 Brown ..... 273/274
6,422,563 B1 * 7/2002 Fairchild et al. ..... 273/274

* cited by examiner

*Primary Examiner*—Benjamin H. Layno
(74) *Attorney, Agent, or Firm*—The Law Office of Craig W. Barber; Craig W. Barber

(57) ABSTRACT

The Payroll22 Dice Set has with Letter and Number Characters in place of Dots. The Dice produce scores ranging from 6 to 22 when totaling the point value of each Die rolled. An "A" and "X" score is called a PAYROLL. Alpha-numeric Characters are used to play a Game similar to Blackjack. The Game is played on a Unique Cloth Layout 3 Special Bets are New with the Game and pay 33 to 1 if the Shooter or the House get a PAYROLL score. If both the Shooter and House get a PAYROLL score the payoff is 1000 to 1. For Regular bets, PAYROLL scores pay 3 to 2 and Tie scores are Pushes. Both the Shooter and House roll the Dice to compete for the highest Score and both may roll a second time.

6 Claims, 2 Drawing Sheets

METHOD OF PLAYING A DICE GAME

CROSS-REFERENCE TO RELATED APPLICATIONS

This application claims the benefit of the following provisional application.

Title: Payroll 22 Dice and Dice Game

Application No. 60/310,413

Filing Date: 08/06/01

Relationship: A Provisional Patent Application on the same Invention

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

Field of endeavor: New Dice and Dice Game for use in Casinos, Internet Casinos, and Video Gaming Machines. The PAYROLL 22 Game is a spin-off of the Blackjack Card Game. The Characters on the Dice are alpha-numeric like Playing Cards and the betting is similar Including Insurance Bets. An advertising slogan is "Play Blackjack with Dice".

BRIEF SUMMARY OF THE INVENTION

The PAYROLL 22 Dice Set was developed to draw Blackjack players to the Dice Tables. The total of the Characters on the Dice obtain scores of 6 to 22 as compared to Blackjack obtaining scores of 3 to 21. Many Blackjack players are afraid of the Dice Games as they are complicated to learn, whereas PAYROLL 22 is easy to learn as it uses several familiar rules and procedures used in Blackjack. High score is 22 in place of 21. The House is active in rolling the Dice to compete with the Shooter/Players for the highest score. The Game has three New Bets which are called special PAYROLL bets that pay 33 to 1 and 1000 to 1.

BRIEF DESCRIPTION OF THE SEVERAL VIEWS OF THE DRAWINGS

FIGS. 1 and 2: Depicts each Die in an exploded view. The Material of the Dice may be Celluloid Acetate and their size may be 0.750 inches square with sharp edges and corners to make them turn more often when rolled. The Characters are hot stamped into the material. The Letters "A" and "X" and the Tradenames may be Gold Color. The Letters "B" and "C" may be Silver Color and all Numbers may be White Color. The die of FIG. 1 may be a translucent Light Blue Color Background with the Characters A, B, 4, 5, 6, and 8. The die of FIG. 2 may be is a Translucent Light Purple Color Background with the Characters X, C, 2, 3, 7, and 9.

FIG. 3 Depicts the Billiard Cloth Table Layout. Approximate Size may be 46×80 inches or larger dependant upon the various Dice Table sizes. The background Color may be Teal Green with Rubber Backing. Printing Colors may be White, Red, and Yellow or other Contrasting Colors. A Casinos' Name may also appear. The layout is used in Casinos to guide the players on how to place their Bets and what payoff ratio to expect when the players get a winning score. The Scoreboard area is used to store the Dice that are rolled to keep a record of the scores made.

DETAILED DESCRIPTION OF THE INVENTION

Figure 1:
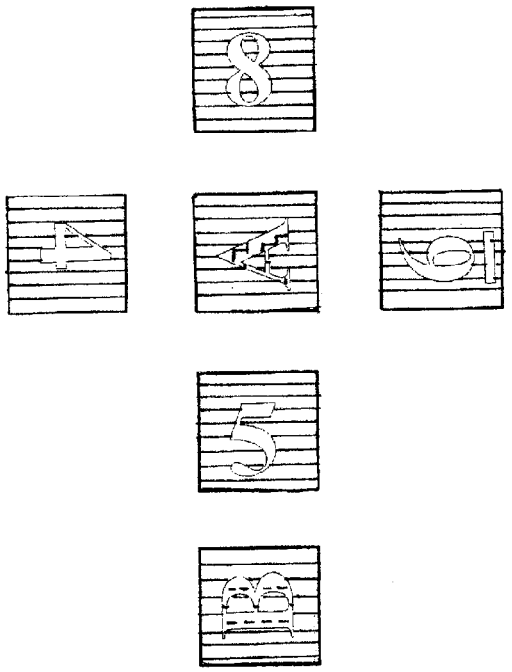
FIGS. 1 and 2: Depicts each Die in an exploded view.
Figure 2:
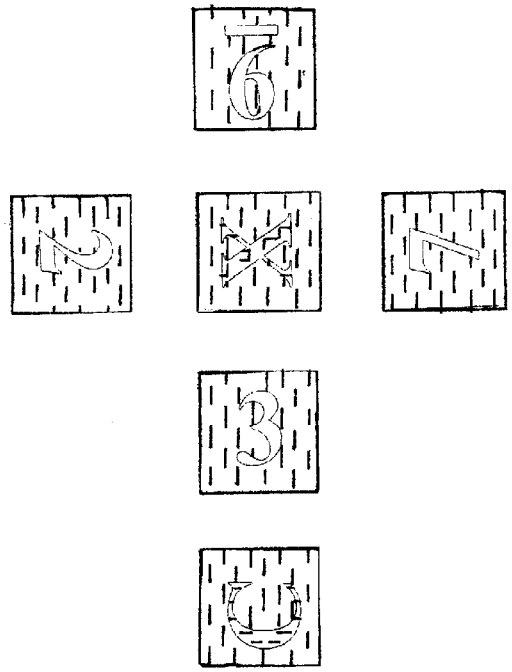

DICE: The Dice Set consists of two Die that have Different alpha-numeric Characters.

Their background colors are different to quickly identify one from the other. If two die have the same background color they are not a correct set and if the colors are different the set is correct. Having different Characters on each Die provides the Characters needed to reach the high scores.

All Number Characters may be colored white, the Letter "B" and "C" Characters may be colored silver and the "A" and "X" Characters may be colored gold. The colors were chosen relative to the score they produce, white being the lowest scores, silver being higher scores and gold being the highest score.

PAYROLL 22 Dice Game: A New Game played similar to Blackjack but using Dice in place of Playing Cards. Many of the same rules are utilized including the insurance Bets along with Regular Bets and higher payoffs for obtaining the High Hand. The High Hand is called a PAYROLL which consists of an "A" and "X" equaling 22 points. Bust scores (Over 22 ) are not possible.

PAYROLL 22 is played on a unique Cloth Layout and a Dice Table. One Player, representing all the Players, rolls the Dice. This Player is called the Shooter. The House also rolls the Dice. The Shooter/Players compete against the House for the highest score. Both the Shooter and the House may roll the Dice a second time but the second score is final. The three New types of bets the Players can make are as follows:

Regular Bets pay 1 to 1 and the shooter/Players getting a PAYROLL score in Regular Bets pays 3 to 2.

3 Special Bets: These bets are paid only on the first roll of the Dice. The 1st pays 33 to 1 when the shooter gets a PAYROLL score, the 2nd pays 33 to 1 when the House gets a PAYROLL score, and the 3rd pays 1000 to 1 when both the House and Shooter get a PAYROLL score (Tie). Special Bets are placed prior to the first roll of the Dice.

Insurance bets are offered when the House rolls an A or X on the first single Die roll and paid 4 to 1 if the House gets a PAYROLL score on their 2nd single Die roll.

When the House's score is equal to or better than the Shooter's, the House collects all Regular score Bets. Ties are pushes, neither collected nor paid.

Complete Rules

Figure 3:
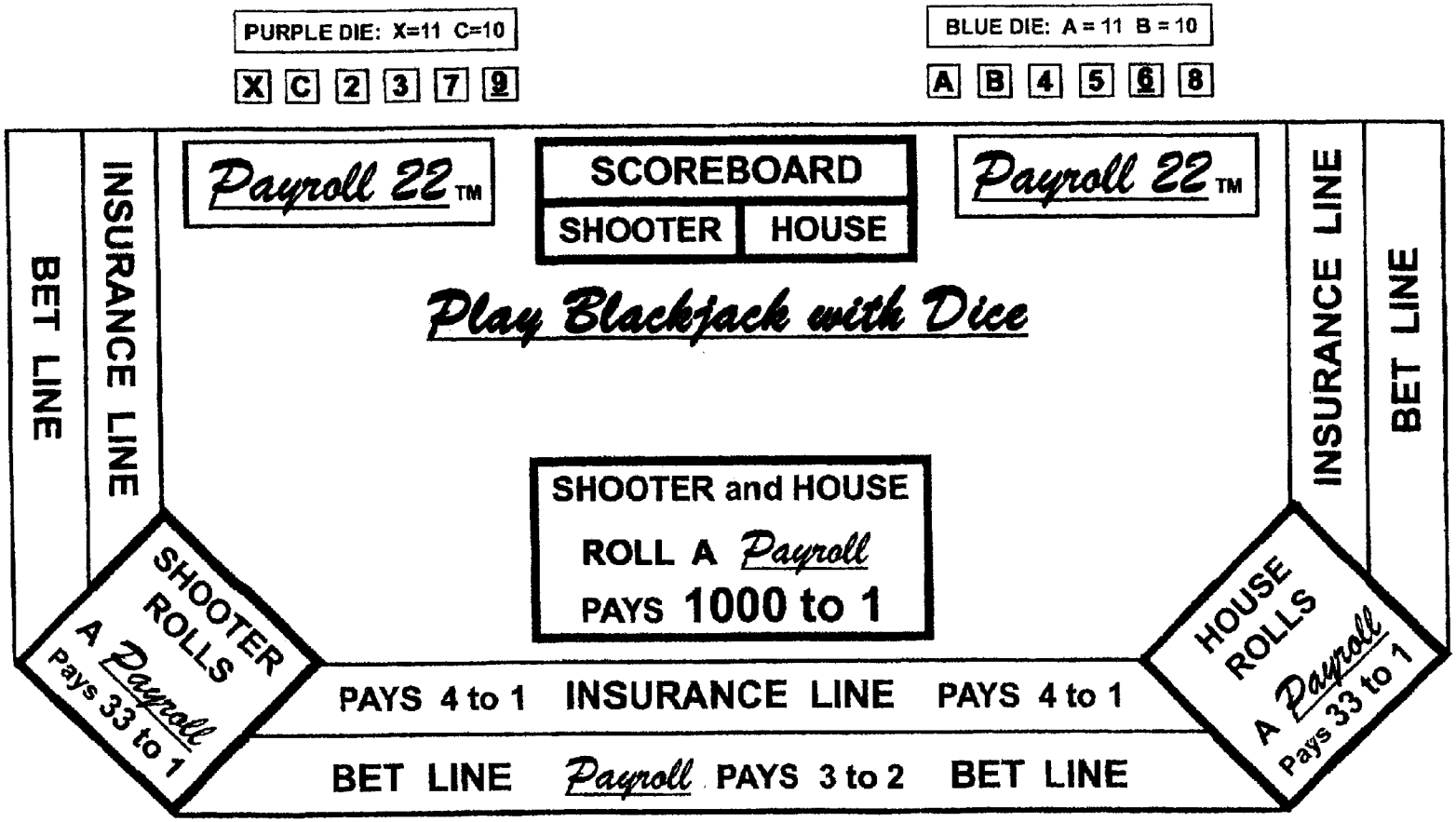
FIG. 3: Depicts the Billiard Cloth Table Layout.

The invention is a new game similar to Blackjack but played upon a Dice Table. The game uses Dice in place of Playing Cards and unlike other Dice Games it is easy to play which eliminates a beginner's fear of rolling Dice. A unique Teal Green Color Cloth Layout may be is used and shown on FIG. 3. The High Score is 22.

In the set of 2 Die, each have different Letter and Number Characters. Each Die may have a Different background color to ensure that each Set has 2 Different Die. Their point values are:

Letters A and X=11 Points Each—Gold Color

Letters B and C=10 Points Each—Silver Color

Numbers 2 thru 9 =their Face Value—White Color

A. The letters on the Dice combined make the highest scores as follows:

A and X both a Gold Color=22 points. This is called a Payroll score. It has special payoffs as explained below.

A and C or X and B Gold and Silver Colors=21 points.

B and C both a Silver Color=20 points. This outranks the same score made with an A and 9 Gold and White Colors.

B. The method of play is similar to that of other Dice Games in that one Player is the Shooter and the other Players bet on the Shooters score. Each Player takes a turn as the Shooter in a Clockwise order around the Table. The Shooter may continue rolling additional Games until losing a Game.

C. The total scores range from 6 thru 22. A Bust score (over 22) cannot happen. The Shooter/Players compete against the House for the highest score. First the Shooter completes his/her Roll(s) then the House. Both the Shooter and the House have the option of rolling a second time to try for a higher score than their first roll. The second roll score is the final score even if it is lower than the first roll.

D. A Payroll Bet is a bet that the House, Shooter or Both make a Payroll score (22) on the first roll of the Dice. Bets are placed either in the left hand corner to bet on the Shooter, in the right hand corner to bet on the House or the center of the table to bet on both the Shooter and House (a Tied Payroll). The Shooter Payroll Bet and the House Payroll Bet pay 33 to 1. A Tied Payroll Bet pays 1000 to 1 and pays all 3 Payroll bets.

E. The Play: All Players place their regular bets on the Bet Line. The Shooter rolls the Dice and the House declares the score. If the Shooter stands on the first roll, the House moves the Dice to the Shooter's Scoreboard. The Shooter may Roll a second time by rolling the same set of Dice if He/She dislikes the score made on the first roll.

F. When a Shooter "Second Roll" Occurs: The House declares that score and moves the Shooter's Dice to the Shooter's Scoreboard. The House then rolls one Die of their set and declares the House score. If the Die lands with an "A" or "X" up the House calls for Insurance Bets and moves the first Die to the House's Scoreboard. (The House Must roll 2 individual Die on their first set to facilitate Insurance betting.)

G. Insurance is a Side Bet which says 4 to 1 if the House gets a Payroll score on the second single Die Roll. Bets are placed on the Insurance Line. The House then rolls their second single Die and immediately pays or collects the insurance bets. If the House score is higher than the Shooter's score, the House collects the Players Regular bets and this ends the Game.

H. If the House first score is lower than the Shooter's score the House must roll again using Both Die of the same Set. The House must stand on Tie scores. The House then declares their final score. Bets are paid or collected as follows and this ends the Game.

I. Payoffs and Collections: See TABLE 1 below for special payoffs of Payroll scores. Shooter has the highest score: All Players win the amount of their bets unless Shooter has a Payroll score the house pays players 3 to 2. House has highest score: House collects all Players bets. House and Shooter having the same score: a Push, neither paid nor collected. In a score of 20, the two Silver letters "B" and "C" outrank Gold and White colors "A" and "9".

TABLE 1

| Who has a Payroll Score | Regular Bets | Special Payroll Bets |
|---|---|---|
| House Only | House Collects all Bets | House Pays 33 times the Bets if House gets a Payroll |
| Shooter Only | House Pays all Players 1 1/2 Times Their Bets | House Pays 33 times the Bets if Shooter gets a Payroll |
| House and Shooter (Tie) | House neither Collects nor pays the Tie score Bets | House Pays 1000 times the Bets on a Tie Payroll score All of the above are paid on the first roll of Dice only |

What is claimed is:

1. A method of playing a dice game having a plurality of players playing against a house, the method comprising:

a) providing first and second six sided dice, the first die being of a first color, the second die being of a second color;

a1) the first die having on a first side the number 4, on a second side the number 5, on a third side the number 6, on a fourth side the number 8, on a fifth side the letter A, and on a sixth side the letter B;

a2) the second die having a first side the number 2, on a second side the number 3, on a third side the number 7, on a fourth side the number 9, on a fifth side the letter C, and on a sixth side the letter X;

b) providing a cloth layout having imprinted thereon a bet line;

c) allowing such players to place bets upon the bet line;

d) having a first such player roll the dice;

e) allowing the first such player to keep the results of the first roll or reroll the dice one time and keep the results of the second roll;

f) having such house roll the dice;

g) allowing such house to keep the results of the first roll or reroll the dice one time and keep the results of the second roll;

h) comparing the total shown after the dice were rolled by the first player with the total shown on the dice after the dice were rolled by the house, the total computed by adding the numbers shown on the dice with A and X equated to 11 each, while B and C are equated to 10 each;

I) paying players whose bets on the bet line match the outcome of the dice rolling.

2. The method of playing a dice game according to claim 1, wherein the first color of the provided dice is light blue and the second color of the provided dice is light purple.

3. The method of playing a dice game according to claim 1, wherein the numbers provided upon the dice are white colored, and wherein the letters A and X are gold colored, and wherein the letters B and C are silver colored.

4. The method of playing a dice game according to claim 1, further comprising:

j) repeating steps c) through I) with the first player if the first player had a higher score than the house;

k) selecting a second player and repeating steps c) through j) with the second player.

5. The method of playing a dice game according to claim 1, further comprising:

g1) if the results of the house first roll are less than the results of the first player's roll, the house must reroll the second time, otherwise, the house must keep the results of the first roll.

6. The method of playing a dice game according to claim 1, wherein the step f) of having such house roll two dice further comprises:

f1) rolling the first one of the two house dice;

f2) allowing such players to make insurance bets on the bet line;

f3) rolling the second one of the two house dice.

* * * * *